US005439437A

United States Patent [19]

Lyons

[11] Patent Number: 5,439,437

[45] Date of Patent: Aug. 8, 1995

[54] CHAIR MOUNTED FOOT MASSAGER

[76] Inventor: Daniel R. Lyons, 509 Cornelia St., No. Mankato, Minn. 56003

[21] Appl. No.: 220,197

[22] Filed: Mar. 30, 1994

[51] Int. Cl.[6] ..... A61H 15/00

[52] U.S. Cl. ..... 601/115; 601/118

[58] Field of Search ..... 297/423.1; 601/49, 51, 601/52, 97–99, 115, 118, 102, 104, 61–65

[56] References Cited

U.S. PATENT DOCUMENTS

| | | | |
|---|---|---|---|
| 719,301 | 1/1903 | Campbell | 297/423.1 |
| 872,126 | 11/1907 | Hart | 601/123 X |
| 2,667,867 | 2/1954 | Petersen | 601/118 |
| 2,767,707 | 10/1956 | Toivonen | 601/118 |
| 3,633,571 | 1/1972 | Shinagawa et al. | 601/118 |
| 3,835,844 | 9/1974 | Lang | 601/49 |
| 4,167,940 | 9/1979 | Ruf | 128/57 |
| 4,173,972 | 11/1979 | Kodera | 601/102 |
| 4,205,663 | 6/1980 | Fujiwara | 128/57 |
| 4,267,610 | 5/1981 | Blakeway et al. | 601/115 X |
| 4,347,838 | 9/1982 | McCauley | 128/33 |
| 5,005,560 | 4/1991 | Quam et al. | 128/57 |
| 5,088,789 | 2/1992 | LaPointe et al. | 297/423.28 X |
| 5,131,383 | 7/1992 | Juarez | 128/25 B |
| 5,137,016 | 8/1992 | Yamasaki et al. | 601/102 |

FOREIGN PATENT DOCUMENTS

| | | | |
|---|---|---|---|
| 2334342 | 7/1977 | France | 601/115 |
| 2639038 | 3/1978 | Germany | 601/120 |

*Primary Examiner*—Michael A. Brown
*Assistant Examiner*—Brian E. Hanlon

[57] ABSTRACT

A generally C-shaped support flange mounted to a footrest of a reclining chair that permits the pivoting of the footrest relative to the chair. The support flange structure mounts adjacent massaging rollers thereon and is secured to the support flange at a rear end wall portion thereof to permit an individual to selectively direct the individual's feet across the rollers for massaging action.

6 Claims, 2 Drawing Sheets

CHAIR MOUNTED FOOT MASSAGER

BACKGROUND OF THE INVENTION

1. Field of the Invention

The field of invention relates to massage apparatus, and more particularly pertains to a new chair mounted foot massager arranged for mounting to a footrest of an associated chair member.

2. Description of the Prior Art

Various foot massage structure is indicated in the prior art and exemplified in U.S. Pat. Nos. 4,167,940; 5,005,560; 5,131,383; 4,347,838; and 4,205,663.

The instant invention attempts to overcome deficiencies of the prior art by providing for a chair member with foot massage structure arranged for ease of use as well as effectiveness in construction and in this respect, the present invention substantially fulfills this need.

SUMMARY OF THE INVENTION

In view of the disadvantages inherent in the known types of foot massage apparatus now present in the prior art, the present invention provides a chair mounted foot massager wherein the same is mounted to a footrest of a chair assembly to permit the massaging of the individual's feet while seated within the chair.

To attain this, the present invention provides a generally C-shaped support flange mounted to a footrest of a reclining chair that permits the pivoting of the footrest relative to the chair. The support flange structure mounts adjacent massaging rollers thereon and is secured to the support flange at a rear end wall portion thereof to permit an individual to selectively direct the individual's feet across the rollers for massaging action.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new chair mounted foot massager which may be easily and efficiently manufactured and marketed.

It is a further object of the present invention to provide a new chair mounted foot massager which is of a durable and reliable construction.

An even further object of the present invention is to provide a new chair mounted foot massager which is susceptible of a low cost of manufacture with regard to both materials and labor, and which accordingly is then susceptible of low prices of sale to the consuming public, thereby making such chair mounted foot massagers economically available to the buying public.

Still yet another object of the present invention is to provide a new chair mounted foot massager which provides in the apparatuses and methods of the prior art some of the advantages thereof, while simultaneously overcoming some of the disadvantages normally associated therewith.

Even still yet another object of the present invention is to provide a new chair mounted foot massager in which a generally C-shaped support flange is mounted to a support plate of a reclining chair, with the support flange structure mounting adjacent massaging rollers thereon to permit an individual to selectively direct the individual's feet across the rollers for massaging action.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
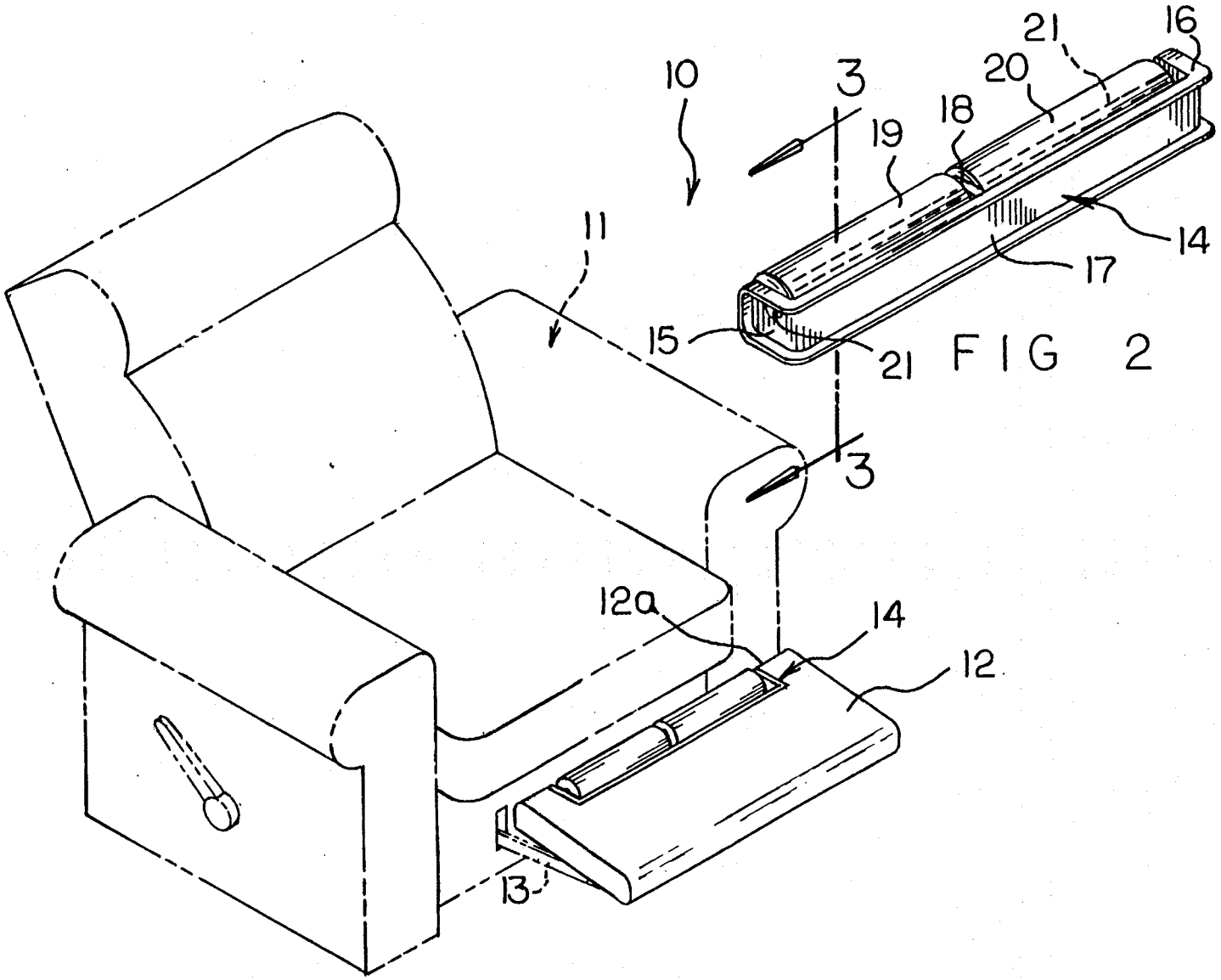
FIG. 1 is an isometric illustration of the invention.
FIG. 2 is an enlarged isometric illustration of the support flange structure arranged for securement to the footrest of the chair structure.
Figure 3:
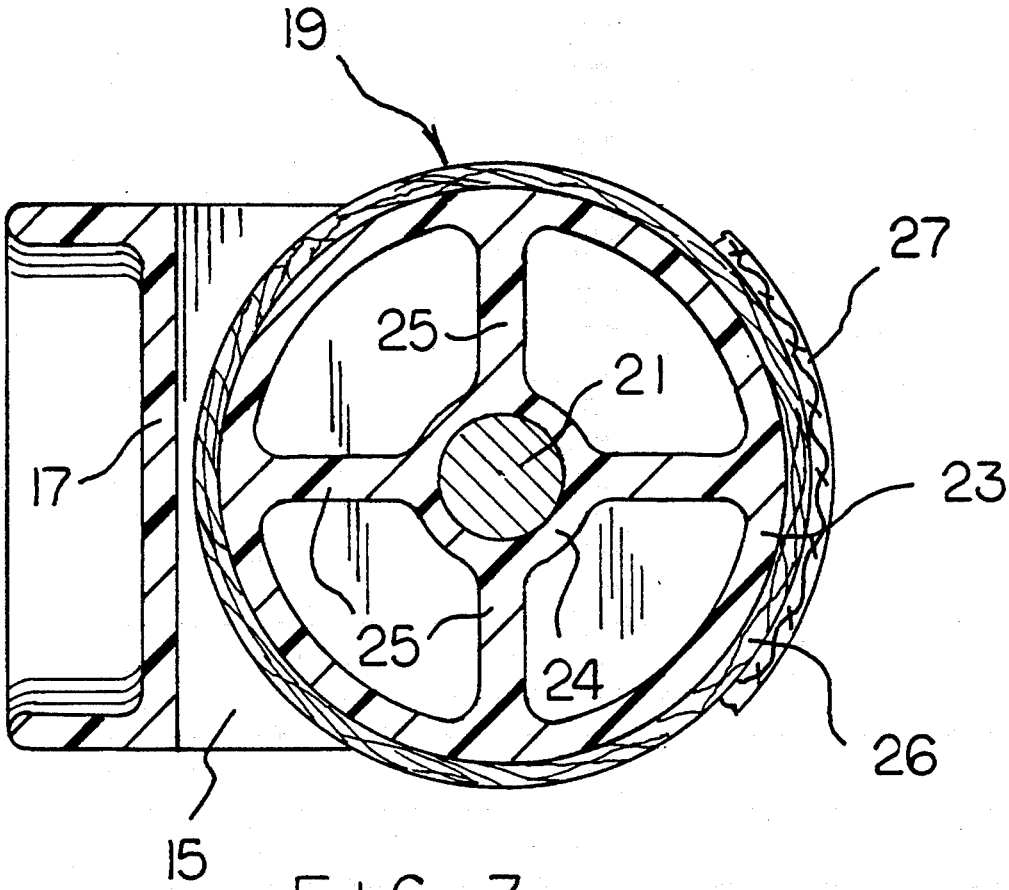
FIG. 3 is an orthographic view, taken along the lines 3—3 of FIG. 2 in the direction indicated by the arrows.

With reference now to the drawings, and in particular to FIGS. 1–4 thereof, a new chair mounted foot massager embodying the principles and concepts of the present invention and generally designated by the reference numeral 10 will be described.

More specifically, the chair mounted foot massager 10 of the instant invention comprises a chair member 11, having a footrest 12 arranged for pivoting to the chair, with at least one support flange 13 supporting the footrest relative to the chair structure. The footrest 12 includes a rear end wall **12*a* into which a C-shaped support flange 14 is directed into the footrest, such that the support flange 14 does not project beyond the rear end wall, as illustrated in FIG. 1. Referring now to FIG. 2, the support flange 14 includes spaced parallel first and second leg plates 15 and 16 that are arranged in a coextensive relationship, with a central plate 18 oriented parallel and medially of the first and second leg plates 15 and 16. A connecting web 17 extends integrally and orthogonally between the plates 15, 16, and 18 to mount the first and second leg plates, as well as the central plate 18**, in the spaced, parallel arrangement.

Figure 4:
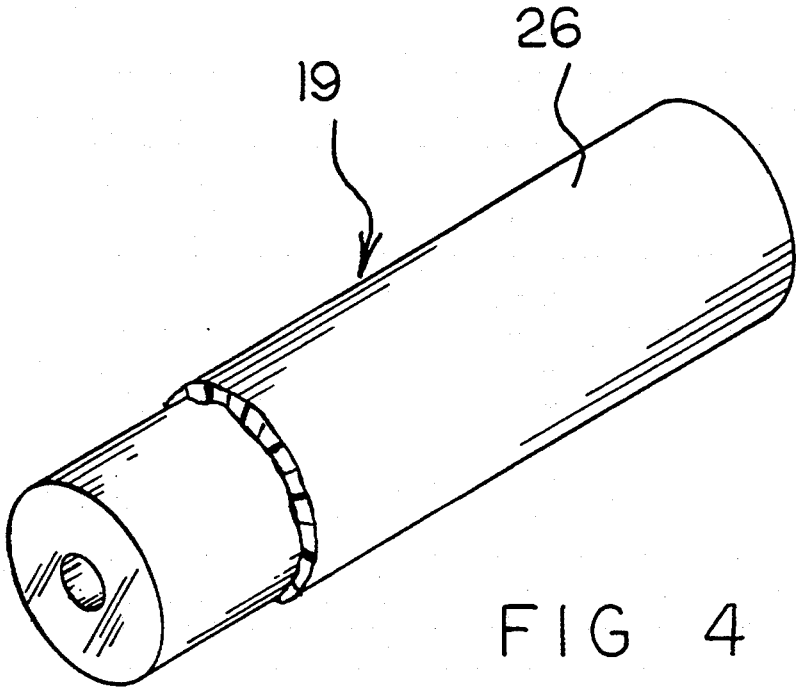
FIG. 4 is an isometric illustration of the roller structure.

A first roller 19 is rotatably mounted between the first leg plate 15 and the central plate 18, and a second roller 20 is coaxially aligned with the first roller, with the second roller 20 being rotatably mounted between the central plate 18 and the second leg plate 16. The rollers 19, 20 are mounted about a roller axle 21 which extends between the plates 15, 16, and 18. Each roller 19, 20 may be of a solid construction as illustrated in FIG. 4, but is preferably of a construction as indicated in FIG.

3 in which the roller is formed of a substantially resilient outer cylinder 23 concentrically mounted about an inner cylinder 24 by a plurality of connecting webs 25 which allow for deformation of the outer cylinder to increase the massaging effect attained through a rotation of the rollers 19, 20 against the individual's feet or legs. To complete the rollers 19, 20, as illustrated for only one roller 19 in FIGS. 3 and 4, each roller includes an outer cushion web 26 mounted about the outer cylinder 23 and may additionally include a fabric covering 27 of a matching color relative to the fabric of the chair 11. By this structure, an individual may massage that individual's feet by positioning an individual foot onto an individual one of the first and second rollers 19 and 20.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A chair mounted foot massager comprising in combination:

a chair member having a forward end and a footrest projecting from the forward end, with the footrest including a substantially planar member having a rear end wall thereof positioned in facing relationship relative to the forward end of the chair member, the planar member being shaped so as to define a substantially rectangular recess directed into the planar member from the rear end wall thereof;

a C-shaped support flange positioned within the rectangular recess of the planar member of the footrest from the rear end wall, the C-shaped support flange having a first leg plate and a second leg plate, the first leg plate being spaced from and parallel to said second leg plate, with an intermediate central plate positioned medially of the first leg plate and the second plate in a parallel coextensive relationship with the first and second plates;

a substantially straight roller axle directed between the first and second plates;

a first roller rotatably mounted about the roller axle between the first leg plate and the central plate;

a second roller rotatably mounted about the roller axle between the central plate and the second leg plate.

2. A foot massager as set forth in claim 1, wherein the first roller and the second roller each comprises an inner rigid cylinder, having an outer porous cushion web.

3. A foot massager as set forth in claim 1, wherein each of the rollers comprises a substantially resilient outer cylinder concentrically mounted about an inner cylinder by a plurality of connecting webs which allow for deformation of the outer cylinder to increase the massaging effect attained through a rotation of the rollers against an individual's feet and legs.

4. A foot massager as set forth in claim 3, wherein each of the rollers further comprises an outer cushion web mounted coextensively and concentrically about the outer cylinder.

5. A foot massager as set forth in claim 4, wherein each of the rollers further comprises a fabric covering mounted coextensively and concentrically about the outer cushion web.

6. A chair mounted foot massager comprising in combination:

a chair member having a chair body and a foot rest, the chair body having a forward end, with the footrest projecting from the forward end of the chair body, the footrest comprising a substantially planar member having a rear end wall thereof positioned in a facing relationship relative to the forward end of the chair member, the planar member being shaped so as to define a substantially rectangular recess directed into the planar member from the rear end wall thereof;

a C-shaped support flange positioned within the rectangular recess of the planar member of the footrest from the rear end wall, the C-shaped support flange comprising an elongated connecting web having a first leg plate projecting substantially orthogonally from a first end of the connecting web, a second leg plate projecting substantially orthogonally from a second end of the connecting web, and an intermediate central plate projecting substantially orthogonally from a medial portion of the connecting web so as to be positioned medially of the first leg plate and the second leg plate, the plates being positioned in a substantially spaced and parallel orientation relative to one another;

a substantially straight roller axle directed between the first and second leg plates and through the central plate;

a first roller rotatably mounted about the roller axle between the first leg plate and the central plate; and, a second roller rotatably mounted about the roller axle between the central plate and the second leg plate.

* * * * *